US006905430B2

(12) United States Patent
Davis

(10) Patent No.: US 6,905,430 B2
(45) Date of Patent: Jun. 14, 2005

(54) WATER SKIPPING ARTICLE INCORPORATING ELLIPTICAL OUTLINE AND HOLLOWED INTERIOR CORE

(75) Inventor: Glen Davis, 8830 Sussex Dr., White Lake, MI (US) 48386

(73) Assignee: Glen Davis, White Lakes, MI (US)

( * ) Notice: Subject to any disclaimer, the term of this patent is extended or adjusted under 35 U.S.C. 154(b) by 379 days.

(21) Appl. No.: 09/837,824

(22) Filed: Apr. 18, 2001

(65) Prior Publication Data

US 2002/0155908 A1 Oct. 24, 2002

(51) Int. Cl.[7] ..... A63B 65/10; A63B 67/06
(52) U.S. Cl. ..... 473/588
(58) Field of Search ..... 473/588, 595, 473/613; 446/46

(56) References Cited

U.S. PATENT DOCUMENTS

| | | | | | |
|---|---|---|---|---|---|
| 2,864,201 | A | * | 12/1958 | Leise | 446/46 |
| 3,544,113 | A | * | 12/1970 | Hand | 473/588 |
| 3,895,801 | A | | 7/1975 | Baird | 273/95 R |
| 4,151,997 | A | | 5/1979 | Glovak et al. | 273/106 B |
| 4,212,462 | A | | 7/1980 | Glovak et al. | 273/424 |
| 4,351,129 | A | | 9/1982 | Kerkenbush et al. | 46/74 |
| 4,395,046 | A | | 7/1983 | Cosmopulos | 273/424 |
| 4,463,954 | A | | 8/1984 | Panse et al. | 273/424 |
| 4,553,758 | A | | 11/1985 | Zehr | 273/424 |
| 4,568,297 | A | | 2/1986 | Dunipace | 446/46 |
| 4,616,827 | A | * | 10/1986 | Bergland | 473/595 |
| 4,938,486 | A | | 7/1990 | Graf | 273/424 |
| 4,955,841 | A | | 9/1990 | Pastrano | 446/46 |
| 4,979,922 | A | | 12/1990 | Clark | 446/46 |
| 5,288,256 | A | | 2/1994 | Lee et al. | 446/48 |
| 5,348,509 | A | | 9/1994 | Riccardi et al. | 446/46 |
| 5,364,299 | A | | 11/1994 | Hill et al. | 446/176 |
| 5,514,023 | A | | 5/1996 | Warner | 446/153 |
| 5,522,780 | A | * | 6/1996 | Roddy | 473/588 |
| 5,540,610 | A | | 7/1996 | Sneddon | 446/46 |
| 5,679,082 | A | | 10/1997 | Hincke | 473/588 |
| 5,836,840 | A | | 11/1998 | Bustamante et al. | 473/588 |

* cited by examiner

*Primary Examiner*—Steven Wong
(74) *Attorney, Agent, or Firm*—Gifford, Krass, Groh, Sprinkle, Anderson & Citkowski, P.C.

(57) ABSTRACT

A water skipping article for use by a user in launching the article in a substantially horizontal trajectory and with a specified rotation spin. The article includes a three-dimensional body constructed of a biodegradable material and having a smooth and continuous exterior surface with a substantially circular and smooth edged outer perimeter. The body further includes a side profile defined by upper and lower elliptically extending faces and which converge into the smooth profile of the circular outer perimeter. A hollowed, substantially elliptical and interior cavity is defined in substantially centric and suspended fashion within the body. Upon launching of the water skipping article by the user, the configuration of the interior cavity causes centrifugal forces to be applied in a direction towards the solid outer perimeter of the article and to thereby increase individual incidences of the article contacting the water surface in a skipping fashion.

9 Claims, 1 Drawing Sheet

WATER SKIPPING ARTICLE INCORPORATING ELLIPTICAL OUTLINE AND HOLLOWED INTERIOR CORE

BACKGROUND OF THE INVENTION

1. Field of the Invention

The present invention relates generally to water skipping and hydroplaning devices. More particularly, the present invention discloses an advanced and unique water skipping article combining the aspects of a smooth elliptical outer surface and an interior, centrally configured and likewise elliptically shaped cavity or hollow core. While the elliptical outer surface serves to enhance the lift and aerodynamic flight characteristics of the device, the hollowed elliptical inner core creates a gyroscopic effect providing for self righting with increased aeronautical and aerodynamic stability.

2. Description of the Prior Art

The prior art is fairly well documented with examples of water skipping articles and objects. The most basic and earliest type of water skipping device known is a smooth edged and preferably flattened rock or stone, the advantage of which is to provide reasonably level flight trajectory and, hopefully, multiple and individual contact points with the water during skipping.

Attempts have been made in the art to provide a man made, more readily available, and better performing skipping device. One such device is disclosed in U.S. Pat. No. 4,553,758, issued to Zehr, and which teaches a skipping stone formed of a somewhat porous, cementitious material and having a sharply convex peripheral (bulbous lower) edge and a generally cylindrical slightly upwardly converging side wall. The upper surface of the device is generally flat to readily distinguish from its lower water engaging surface. The stone in Zehr is further disclosed as being cast from a mixture of gypsum cement and fine sand and incorporates a radius dimension R and thickness of 0.4 R. A dimpled near-center region extends from the center outwardly about 45% of the radius R.

Glovak U.S. Pat. No. 4,151,997 teaches a hydroplaning disc with a solitary unitary body comprised of aggregated material. The disc is disclosed as being heavier (having a greater density) than the water it displaces and thereby non-floating. A series of longitudinally oriented discontinuities are provided only on the extreme latitudinal periphery of the rim adjacent to the top and bottom surfaces of the disc. The discontinuities exert a greater interfering effect on the airflow and waterflow around the circumference of the disc than over its top and under its bottom. Thus, a turbulent boundary layer is asserted to be created between the layer of air and water and which is alleged to increase the range, frequency of skips and dynamic stability. The bottom of the Glovak article is further disclosed as having a granular texture and which results in a more sure grip and improved hydroplaning stability during skipping motion.

Glovak, U.S. Pat. No. 4,212,462, teaches another type of aerodynamic and hydromechanical hydroplaning disc with a solid unitary body comprised of aggregated material. The disk includes a peripheral edge formed with a top to bottom curvature having a relatively smaller radius at the top than at the bottom and which reduces air resistance while at the same time increasing the planning capacity of the disc as it strikes the water. The texture of the Glovak '462 disk is further such that, in combination with the circular or polygonal edge formations, enhances the aerodynamic, hydrodynamic and hydromechanical characteristics.

Panse U.S. Pat. No. 4,463,954, teaches an aquatic surface skimming (as opposed to skipping or tumbling) projectile and which includes a top, substantially flattened and planar surface and a lower surface including with a frusto-conical shape. The Panse skimming device is disclosed as producing hydrodynamic lift and drag reduction along the water surface and to specifically avoid skipping and tumbling motion.

Finally, Cosmopulus U.S. Pat. No. 4,395,046, teaches a hand thrown game disc for skipping over the surface of water by throwing with a spinning motion and in a generally flat low trajectory. The disc is constructed of a material having a density less than water so that it is floatable thereon. The disc further includes generally auger shaped upper and lower faces (each being oriented in a different direction) and a notch is located in an outer peripheral edge. The auger face is disclosed as providing a lifting motion to the disc and the different auger directions allow the disc to be spun from either hand.

SUMMARY OF THE PRESENT INVENTION

The present invention is a water skipping article combining the aspects of a smooth and elliptical outer surface with an interior, centrally configured and likewise elliptically shaped hollow core or cavity for maximizing the performance characteristics of the skipping device. The present invention is further an improvement over the prior art in that it provides an improved, yet simplified construction, for both enhancing and increasing the incidence of contacts with the water's surface. Additionally, the construction of the skipping device, which incorporates an environmentally inert or biodegradable construction material, makes it amenable to being produced inexpensively and in large numbers, and likewise being consumed by the user in an environmentally friendly manner.

The device itself is constructed of a three-dimensional body incorporating an environmentally inert or biodegradable material and having a smooth, elliptical exterior surface with a circular smooth edged outer perimeter. The body further includes a side profile defined by upper and lower elliptically extending faces which converge into the circular outer perimeter, yielding an exterior shape or outline defined as a perfect ellipse. The body also includes a hollowed interior cavity, also elliptical in shape, centrally positioned and suspended within an otherwise solid construction of the body. The exterior shape and smooth texture provides for increased aerodynamic lift while in flight and decreased aeronautical surface drag or friction when contacting the surface of the water. The hollowed interior cavity enhances centrifugal forces that create a gyroscopic effect to provide for a self-righting, corrective action that increases the aeronautical and aerodynamic stability of the device while skipping and in flight. Prior art, conversely, uses a textured surface and cylindrical sidewalls to provide aeronautical stability. While effective at providing stability, this earlier art form also significantly increases drag, therefore reducing the performance of the device. By using an interior cavity and the gyroscopic effect to provide stability, the invention can utilize a smooth outer surface and aerodynamic shaping to enhance the skipping action. The hollow core allows the device to decrease surface drag without sacrificing stability. When the device is launched rotationally and in substantially horizontal trajectory, these improvements serve to increase the number of surface contacts so as to magnify the skipping action.

BRIEF DESCRIPTION OF THE DRAWING

Reference will now be made to the attached drawing, when read in combination with the following detailed description, wherein like reference numerals refer to like parts throughout the several views, and in which.

DESCRIPTION OF THE PREFERRED EMBODIMENTS

Figure 1:
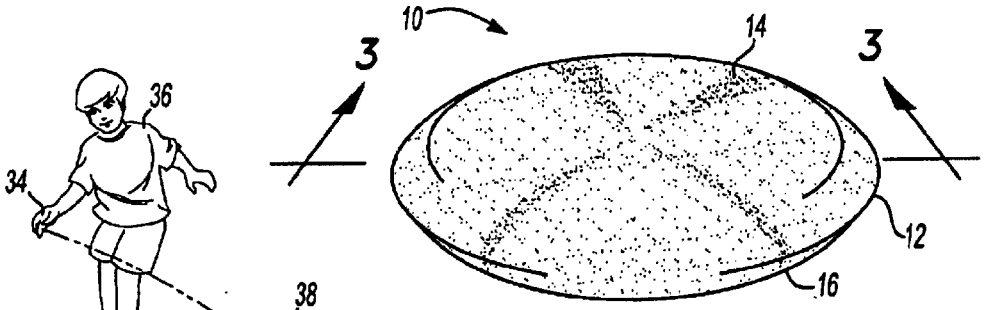
FIG. 1 is a perspective view of the water skipping article according to the present invention.

Referring now to FIG. 1, a water skipping article is illustrated at 10 according to the present invention. As described previously, the water skipping article combines the aspects of a smooth and elliptical exterior configuration with an interior, centrally configured and likewise elliptically shaped cavity for maximizing the performance characteristics of the skipping device. The present invention is further an improvement over the prior art in that it provides an improved, yet simplified construction for both enhancing and increasing the incidence of skipping. Additionally, the construction of the skipping article, which incorporates an environmentally inert or biodegradable material, makes it amenable to being produced inexpensively and in large numbers, and likewise consumed by the user in an environmentally friendly manner.

Referring again to FIG. 1, the water skipping article 10 includes a three-dimensional body, preferably exhibiting a substantially smooth exterior with a substantially circular and smooth edged outer perimeter 12. As best illustrated from the perspective view of FIG. 1, the water skipping article defines a substantially rounded, flattened and "saucer shape" article, defined as a perfect ellipse. The article 10 may further be constructed of an environmentally inert or biodegradable material, thus effectively rendering the present article a disposable article which causes no adverse effects to the environment, such as after being skipped along a water surface and subsequently sinking to the bottom of the body of water. It is however also envisioned that the article 10 can be constructed of other types of material, either natural or synthetic, and without departing from the scope of the present invention and the surface texture of the article may also range from smooth to slightly roughened without significantly impacting upon its performance characteristics.

Figure 3:
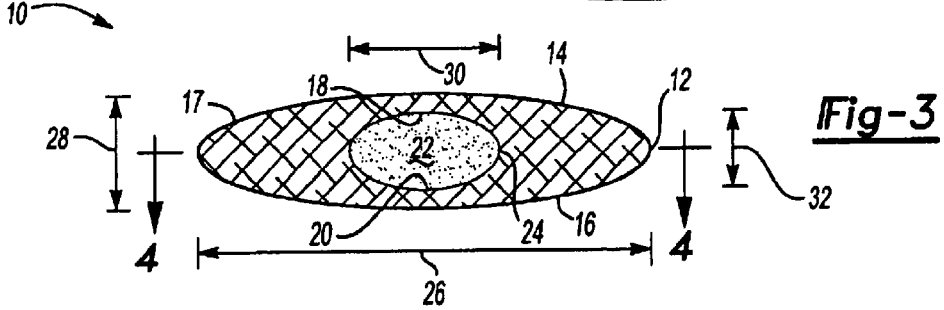
FIG. 3 is a first cutaway view taken along line 3—3 of FIG. 1 and illustrating, in side profile, the arrangement of the interior and likewise elliptically shaped cavity of the water skipping article of the present invention.

Referring also to the side cutaway of FIG. 3, a side profile of the article 10 is defined by the smooth edged outer perimeter 12 and includes both an upper elliptically extending face 14 and a lower elliptically extending face 16. The elliptically extending faces 14 and 16 extend along the top and bottom, respectively, of the article 10 and converge into the smooth edged and circular extending outer perimeter 12 in the fashion again best seen in the side cutaway of FIG. 3. The side view outline and shape of the device is an ellipse.

Figure 4:
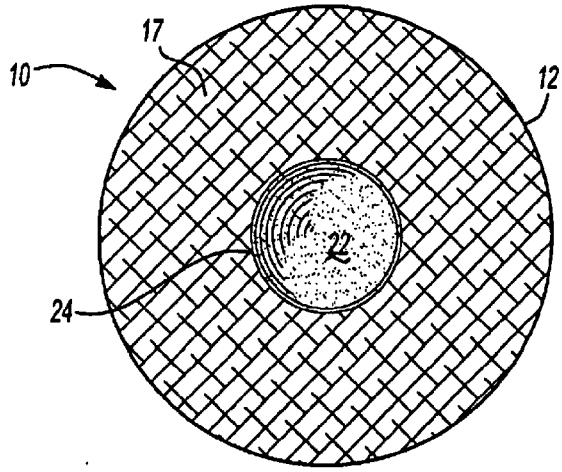
FIG. 4 is a second cutaway view taken along line 4—4 of FIG. 3 and illustrating, in top profile, a further perspective of the interior cavity of the water skipping article according to the present invention.

Referring again to FIG. 3, as well as to the further top cutaway of FIG. 4, the article body defines a substantially solid interior 17 and further includes substantially elliptical and interiorly extending upper and lower surfaces 18 and 20 which define a hollowed, substantially elliptical and interior cavity 22 suspended within the body and located in a substantially centric position within the solid body interior 17. As with the upper and lower elliptically extending faces 14 and 16 defining the outer body perimeter, the interiorly extending upper and lower surfaces 18 and 20 likewise converge along an outer and perimeter extending edge 24. As will also be described in additional detail, it is further understood that the configuration of the edge 24 is not limited to any specific and radial configuration and may modified (such by widening or narrowing the edge 24) to affect the performance characteristics of the article 10 in a desired fashion.

Referring again to FIG. 3, the outer body establishes a specified width (see dimensional arrow 26) and thickness (see dimensional arrow 28). Experimentation and testing has indicated that optimum flying, spinning and skipping characteristics are achieved at an established width 26 to thickness 28 ratio of 4:1, combined with the elliptical upper and lower face configuration of the body. The preferred embodiments of the invention are not however limited to any set ratio of width to thickness, it also being understood that other ratios such as 3:1, 5:1 or some intermediate variation in the range of width to thickness may be incorporated and with varying effect on the performance of the article 10 of the present invention.

Referring again to FIG. 3, the interiorly configured cavity 22 likewise establishes a specified width (see dimensional arrow 30) and thickness (see dimensional arrow 32). As with the outer article body characteristic, experimentation and testing has indicated that optimum flying, spinning and skipping characteristics are achieved at an established width 30 to thickness 32 ratio in a range of 2:1 to 3:1, and combined with the elliptical upper and lower face configurations of both the body (14 and 16), as well as the interiorly extending surfaces 18 and 20 defining the cavity 22. As with the outer body of the article 10, the preferred embodiments of the invention are not however limited to any set ratio of width to thickness associated with the interior cavity 22, it also being understood that other ratios may be incorporated into the article 10 and with varying effects on its performance.

Figure 2:
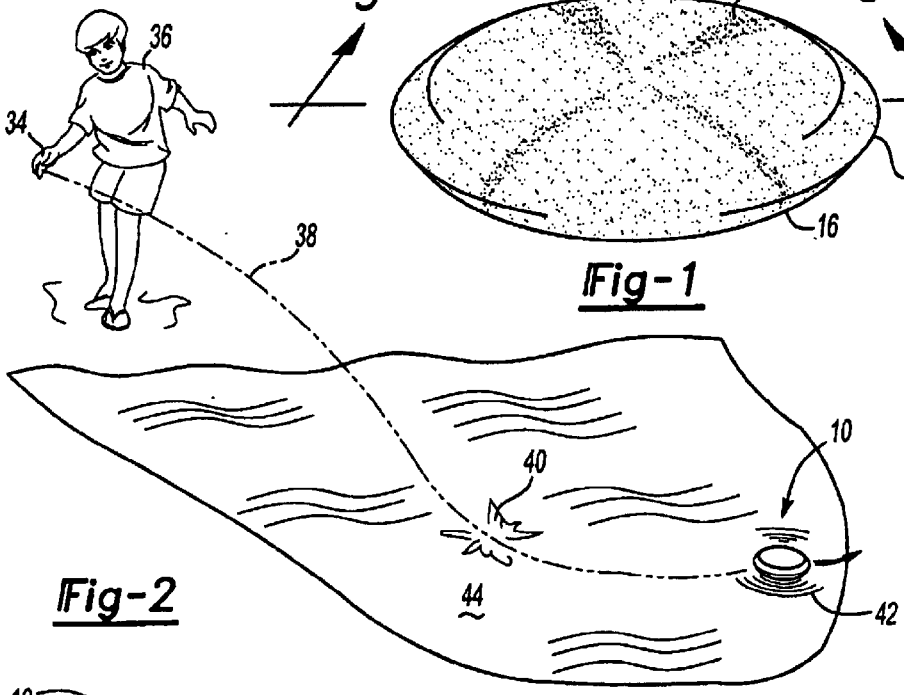
FIG. 2 is an environmental view illustrating the water skipping article in use according to the present invention.

One preferred variant of the skipping article 10 contemplates a body having an overall width in the range of 2" to 4" and an associated thickness in the range of 0.50" to 1.00". Corresponding dimensions of the interiorly configured cavity 22 may further range from 1" to 1½" width and 0.40" to 0.60" thickness. These dimensions have been found to maximize the ease of gripping of the article 10 within a hand 34 of a user 36 (see environmental view in FIG. 2) and, during the sideways throwing/horizontally inducing trajectory motion illustrated in phantom by path 38, tend to maximize the skipping effect, see at 40 and 42, upon the a surface 44 of the body of water. It is further understood that the size (width and thickness) of the article 10 is not limited to any set of dimensions and could theoretically be provided in sizes of up to several inches or more in width and thickness, and such as may facilitate gripping by the user 36.

As is also known in general physics, the incidence of multiple skips (beyond those made possible by the geometry of the article of the present invention) is assisted by surface tension created at the water surface level 44. Surface tension is created at the boundary between the water and air layers by virtue of the absence of downward forces opposing the upward forces directed at the top water layer and by the descending water layers.

Having described my invention, it is evident that it discloses a water skipping article which is an improvement over the prior art in that it provides a typically disposable and low cost article which provides a high degree of skipping trajectory across a water surface. It is also envisioned that the water skipping article may be manufactured in any of a number of fashions, among which including injection molding, press forming or casting operations.

Additional preferred embodiments will become apparent to those skilled in the art to which it pertains and without deviating from the scope of the appended claims:

I claim:

1. A water skipping article, comprising:

a three-dimensional body having a substantially smooth and elliptical exterior surface, an outermost extending perimeter edge being circular in outline, said body further including a side profile defined by upper and lower elliptically extending faces which converge into said outer perimeter, and said body exhibiting a smooth and continuous exterior surface and further defining a hollowed and interior cavity suspended within said body, said body further including substantially elliptical and interiorly extending surfaces defining said interior cavity;

wherein, upon a user launching said article in a substantially horizontal trajectory and with a specified rotational spin, said interior cavity causing centrifugal forces to be applied to said outer perimeter of said article and said elliptically extending faces increasing individual incidences of said article contacting a water surface.

2. The water skipping article as described in claim 1, said body having a specified width and thickness and being constructed from at least one of an environmentally inert and biodegradable material.

3. The water skipping article as described in claim 1, said body having a specified width to thickness ratio in a range of between 3:1 to 5:1.

4. The water skipping article as described in claim 1, said elliptical and interiorly extending surfaces defining said interior cavity further having a specified width to thickness ratio of at least 2:1.

5. The water skipping article as described in claim 4, said elliptical and interiorly extending surfaces defining said interior cavity further defining a specified width to thickness ratio of between 2:1 to 3:1.

6. The water skipping article as described in claim 3, said body having a width in the range of between 2.0" to 4.0" and a thickness in a range of 0.500" to 1.00".

7. The water skipping article as described in claim 6, said body including said elliptical interior cavity defining a width in the range of 1" to 1.5" and a thickness in the range of 0.4" to 0.6".

8. A water skipping article for use by a user in launching the article in a substantially horizontal trajectory and with a specified rotational spin, said article comprising:

a three-dimensional body constructed of a material selected from at least one of biodegradable materials and environmentally inert materials and having an elliptically shaped smooth and continuous exterior surface with a substantially circular and smooth edged outer perimeter, said body further including a side profile defined by upper and lower elliptically extending faces which converge into said outer perimeter; and said body further defining a hollowed, substantially elliptical and interior cavity suspended within said body, said interior cavity causing centrifugal forces to be applied to said outer perimeter of said article, upon launching by said user and increasing individual incidences of said article contacting a water surface in a skipping fashion.

9. A water skipping article, comprising:

a three-dimensional body having a substantially smooth edged and circular outer perimeter, said body further including a side profile defined by a first ellipse created by upper and lower elliptically extending faces which converge into said outer perimeter, and said body exhibiting a smooth and continuous exterior surface and further defining a hollowed and interior cavity suspended within said body, said body further including a second ellipse created by substantially elliptical and interiorly extending surfaces defining said interior cavity, said second inner ellipse being of a different width to thickness ratio than that of said first ellipse;

wherein, upon a user launching said article in a substantially horizontal trajectory and with a specified rotational spin, said elliptical configuration of said interior cavity causing centrifugal forces to be applied to said outer perimeter of said article and said elliptically extending faces increasing individual incidences of said article contacting a water surface.

* * * * *

UNITED STATES PATENT AND TRADEMARK OFFICE

CERTIFICATE OF CORRECTION

PATENT NO. : 6,905,430 B2
DATED : June 14, 2005
INVENTOR(S) : Glen Davis

It is certified that error appears in the above-identified patent and that said Letters Patent is hereby corrected as shown below:

Column 5,
Lines 19-30, please delete

"said body exhibiting a smooth and continuous exterior surface and further defining a hollowed and interior cavity suspended within said body, a substantially solid interior of said body surrounding a perimeter extending edge associated with said interior cavity, said body further including substantially elliptical and interiorly extending surfaces defining said interior cavity;

wherein, upon a user launching said article in a substantially horizontal trajectory and with a specified rotational spin, said interior cavity causing centrifugal forces to be applied to said outer perimeter of said article and said elliptically extending faces increasing individual incidences of said article contacting a water surface."

and please insert

-- said body exhibiting a smooth and continuous exterior surface and further defining a hollowed and interior cavity located in a substantially centric position within said body, a substantially solid interior of said body surrounding a perimeter extending edge associated with said interior cavity, said body further including substantially elliptical and interiorly extending surfaces defining said interior cavity;

wherein, upon a user launching said article in a substantially horizontal trajectory and with a specified rotational spin, said interior cavity resulting in centrifugal forces being focused about said solid interior and in a direction towards said outer perimeter of said article, said configuration of ~~and~~ said elliptically extending and exterior faces increasing individual incidences of said article contacting a water surface.--

Column 6,
Lines 18-23, please delete

"said body further including a side profile defined by upper and lower elliptically extending faces which converge into said outer perimeter; and said body further defining a hollowed, substantially elliptical and interior cavity suspended within said body, a substantially solid interior of said body surrounding a perimeter extending edge associated with said interior cavity, said interior cavity causing centrifugal forces to be applied to said outer perimeter of said article, upon launching by said user and increasing individual incidences of said article contacting a water surface in a skipping fashion."

and please insert

-- said body further defining a hollowed, substantially elliptical and interior cavity located in a substantially centric position within said body, a substantially solid interior of said body surrounding a perimeter extending edge associated with said interior cavity, said interior cavity resulting in centrifugal forces being focused about said solid interior and in a direction towards said outer perimeter of said article, upon launching by said user, said exterior elliptical configuration increasing individual incidences of said article contacting a water surface in a skipping fashion.--

UNITED STATES PATENT AND TRADEMARK OFFICE

CERTIFICATE OF CORRECTION

PATENT NO. : 6,905,430 B2
DATED : June 14, 2005
INVENTOR(S) : Glen Davis

It is certified that error appears in the above-identified patent and that said Letters Patent is hereby corrected as shown below:

Column 6 (cont'd),
Lines 25-45, please delete

"said body exhibiting a smooth and continuous exterior surface and further defining a hollowed and interior cavity suspended within said body, said body further including a second ellipse created by substantially elliptical and interiorly extending surfaces defining said interior cavity, said second inner ellipse being of a different width to thickness ratio than that of said first ellipse;

wherein, upon a user launching said article in a substantially horizontal trajectory and with a specified rotational spin, said elliptical configuration of said interior cavity causing centrifugal forces to be applied to said outer perimeter of said article and said elliptically extending faces increasing individual incidences of said article contacting a water surface."

please insert

-- said body exhibiting a smooth and continuous exterior surface and further defining a hollowed and interior cavity located in a substantially centric position within said body, a substantially solid interior of said body surrounding a perimeter extending edge associated with said interior cavity, said body further including a second ellipse created by substantially elliptical and interiorly extending surfaces defining said interior cavity, said second inner ellipse being of a different width to thickness ratio than that of said first ellipse;

wherein, upon a user launching said article in a substantially horizontal trajectory and with a specified rotational spin, said elliptical configuration of said interior cavity resulting in centrifugal forces being focused about said solid interior and in a direction towards said outer perimeter of said article, said configuration of said elliptically extending and exterior faces increasing individual incidences of said article contacting a water surface.--

Signed and Sealed this

Eighth Day of November, 2005

JON W. DUDAS
*Director of the United States Patent and Trademark Office*